US009010161B2

(12) United States Patent
Oliana

(10) Patent No.: US 9,010,161 B2
(45) Date of Patent: Apr. 21, 2015

(54) PROTECTIVE DEVICE, PARTICULARLY FOR A LOCK OF A DOOR OR LEAF

(76) Inventor: Pier Luigi Oliana, Conegliano (IT)

( * ) Notice: Subject to any disclaimer, the term of this patent is extended or adjusted under 35 U.S.C. 154(b) by 0 days.

(21) Appl. No.: 13/451,771

(22) Filed: Apr. 20, 2012

(65) Prior Publication Data

US 2012/0291504 A1 Nov. 22, 2012

(30) Foreign Application Priority Data

May 20, 2011 (IT) ..... TV2011A0069

(51) Int. Cl.

| | |
|---|---|
| ***E05B 47/00*** | (2006.01) |
| ***E05B 17/18*** | (2006.01) |
| ***E05B 17/14*** | (2006.01) |
| ***E05B 37/12*** | (2006.01) |

(52) U.S. Cl.

CPC ..... *E05B 17/186* (2013.01); *E05B 17/145* (2013.01); *E05B 37/12* (2013.01); *E05B 47/004* (2013.01); *E05B 47/0045* (2013.01)

(58) Field of Classification Search

USPC ..... 70/89, 90, 276, 413, 416, 417, 423, 70/427, 453, 454, 455

See application file for complete search history.

(56) References Cited

U.S. PATENT DOCUMENTS

| | | | | |
|---|---|---|---|---|
| 1,078,156 | A * | 11/1913 | Locher | 70/427 |
| 3,732,711 | A | 5/1973 | Albert | |
| 3,948,068 | A * | 4/1976 | Stackhouse | 70/276 |
| 3,967,479 | A * | 7/1976 | Vick | 70/276 |
| 4,073,165 | A * | 2/1978 | Grundstrom et al. | 70/37 |
| 4,793,165 | A * | 12/1988 | Rochman | 70/284 |
| 5,916,282 | A * | 6/1999 | Elm et al. | 70/423 |
| 6,499,327 | B1 * | 12/2002 | Sugimoto | 70/423 |
| 7,621,161 | B2 * | 11/2009 | Fontana et al. | 70/276 |

FOREIGN PATENT DOCUMENTS

| | | | |
|---|---|---|---|
| DE | 8902827 | U1 | 7/1990 |
| DE | 9110751 | U1 | 12/1992 |
| DE | 4419348 | C1 | 5/1995 |
| DE | 202005008508 | U1 | 10/2006 |
| DE | 202005015298 | U1 | 2/2007 |

OTHER PUBLICATIONS

Search Report for Italian Application No. TV 2011000068, 6 pages.
Search Report for Italian Application No. TV 2011000069, 7 pages.

* cited by examiner

*Primary Examiner* — Christopher Boswell
(74) *Attorney, Agent, or Firm* — Lando & Anastasi, LLP

(57) ABSTRACT

A protective device, particularly for a lock of a door or leaf, comprising a covering element which is associated slidingly with a plate that can be fixed to the door or leaf and can be positioned selectively so as to close an opening for access to the lock which is provided in the plate. Two pins are associated transversely with the plate and are adapted to block temporarily the sliding of the covering element with respect to the plate. The device has at least one cam, freely mounted rotatably within a cavity provided in the plate. At least one first recess and at least one second recess are provided in the lateral surface of the at least one cam, which have, in plan view, a mutually different shape and are adapted respectively to allow and prevent the sliding of the covering element.

10 Claims, 12 Drawing Sheets

PROTECTIVE DEVICE, PARTICULARLY FOR A LOCK OF A DOOR OR LEAF

The present invention relates to a protective device, particularly for a lock of a door or leaf, for example a door for access to a home, or a gate, or a door of a safe cabinet.

BACKGROUND OF THE INVENTION

Currently, locks are known which are adapted for example to allow the closure and re-opening of a door or gate and comprise a preset cylinder which can be actuated by means of a suitable key which can be inserted in a keyhole provided axially to this cylinder.

These cylinders of the known type are typically made of brass and therefore do not have a high mechanical strength, being thus easy to break into by drilling and/or breaking and/or stripping.

In order to protect these cylinders of the known type from possible break-ins, it is common to fix to the lock, in such a position as to cover the cylinder, an adapted covering element, which is constituted by a stud which has a substantially circular plan shape and has, at the keyhole of the cylinder, a circular hole inside which a keyhole protection disk, in which there is a slot adapted to allow the insertion of the key, is accommodated rotatably.

The stud constitutes therefore a protection for the cylinder and allows at the same time the insertion and rotation of the key in the keyhole thereof.

These studs of a known type, however, have a drawback: in fact, even after their application the cylinder is partially accessible through the slot of the keyhole protection disk and therefore is still vulnerable to possible tampering or vandalism, such as for example, the introduction of glue or other substances that could damage the cylinder through this slot.

As a partial solution to this drawback, patent application no. TV2003A000115 of Aug. 7, 2003, is known which describes a protective device for the cylinder of a lock which comprises a plate, with an approximately rectangular plan shape, which can be fixed to a door so as to cover the lock, and can be provided, proximate to one end, with a suitable opening for access to the cylinder of said lock.

On the front surface of the plate, which is directed opposite to the lock, there are two adapted seats having a circular plan shape within which two substantially cylindrical cams are accommodated so that they can rotate, two recesses with a semicircular profile being formed radially on their lateral surface; adapted first magnets are inserted within said cams.

Two through ducts are provided on the lateral surface of these seats, along two axes which are transverse to the plate, and suitable lock pins are accommodated within said ducts so that they can slide, said pins having such dimensions as to be partially insertable in the recesses formed in the cams; these pins are pushed toward the outside of the respective ducts, so as to exit transversely from the lateral surfaces of the plate, by the action of adapted springs inserted in said ducts.

A covering element is associated slidingly with the plate and can slide longitudinally thereto, so as to conceal selectively, with one of its ends, the opening for access to the lock.

This covering element has an approximately C-shaped transverse cross-section so as to define a substantially rectangular base arranged, when in use, so as to face the front surface of the plate; two arms protrude from the longitudinal ends of said base, envelop the lateral surfaces of the plate and are slidingly coupled thereto.

Two adapted slots are formed in the surface of said arms that is directed toward the longitudinal surfaces of the plate; in the condition in which the covering element conceals completely the opening for accessing the lock, the pins that protrude transversely from the lateral surfaces of the plate are inserted in said slots so as to block the mutual sliding between the plate and the covering element.

The release of the covering element is achieved by arranging in a complementarily shaped groove formed in the base thereof an adapted magnetic key which contains preset second magnets adapted to mate with the first magnets provided in the cams, in order to cause the rotation of said cams up to the condition in which the recesses formed in them face the channels that contain the pins.

In this condition, a traction of the covering element in the direction of its spacing from the opening for accessing the lock causes the exit of the pins from the cavities formed in the arms of said covering element and the simultaneous partial insertion of said pins in the recesses of the cams; in this manner, the sliding of the covering element with respect to the plate is freed, thus allowing access to the lock.

Once the magnetic key has been removed and the covering element has been repositioned so as to conceal the opening for accessing the lock, the mutual interaction between the first magnets of the two cams causes a rotation thereof such as to break up the alignment of the recesses with respect to the ducts that contain the pins; the covering element is therefore again locked in a closed condition.

However, even this device of a known type has some drawbacks: in fact in disk combination systems, because of the mechanical plays between the various components and because of the different sounds that the disks produce upon contact therewith depending on their mutual position, it is possible, after various listening attempts, to detect the opening position of all the disks and therefore open the lock.

Italian patent no. 01288200 is also known which describes a safety device for the protection of the external side of a system for closing doors or door-frames for entry, which comprises a fixed base element, which is arranged and shaped to surround a locking cylinder, i.e., the hole for the key of the closing system.

In front of the base element there is a longitudinal seat, with two parallel sides, in which a movable body is accommodated so that it can slide; said body can be moved between an active position, in which said movable body is arranged in front of the cylinder, i.e., of the lock hole, concealing it, and a passive position, in which said movable body is spaced from the cylinder, i.e., from the lock hole, so as to allow access thereto.

The device comprises, moreover, a combination system for locking/unlocking the movable body in the active position, constituted by rotating coded knobs which are mounted on the movable body, each one carrying a lock/unlock disk, arranged on the inner face of the movable body, between the sides of the front seat of the base element; on these sides, for each one of the disks, there is a recess which is partially shaped complementarily, in plan view, to the respective disk and is arranged so that when the movable body is in the active position each disk is arranged proximate to one of said recesses.

Each disk, moreover, has a lateral flattened portion, which can be arranged selectively, following the rotation of the disk, at the respective recess or not; with the movable body in the active position, when the flattened portion of a disk is not at the recess, said disk protrudes transversely from the movable body with its curved part, which is thus arranged inside the adjacent recess, preventing the sliding of the movable body with respect to the base element and thus keeping said movable body in the active position.

By rotating in a suitable manner the coded knobs it is possible to rotate the disks until the flattened portion that is present in all of them is at the respective recess; in this condition, the disks do not protrude transversely from the movable body, which is no longer coupled to the base element and can therefore be caused to slide to the passive position.

The release of the movable body is therefore possible only by knowing the correct combination that makes it possible to rotate conveniently the coded knobs and the lock/unlock disks with them.

Even this device of the known type, however, has drawbacks: in fact it is known that in disk combination systems, because of the mechanical plays between the various components, and due to the different sounds that the disks produce upon contact with them depending on their mutual position, it is possible, after various listening attempts, to determine the open position of all the disks and therefore open the lock.

Moreover, in this device of the known type, the position of the coded knobs that makes it possible to achieve the release of the movable body is not defined unequivocally, because in order to achieve the release of the movable body it is sufficient for all the disks to be arranged so that their flattened portion is partially contained in the recess and directed away from the locking cylinder or hole for the key of the closing system; in fact in this condition, which can be obtained with the coded knobs in various positions, by pulling of the movable body in the opening direction the flattened portion of the various disks abuts against the edge of the respective recess, causing the rotation of the respective disk up to the condition in which the curved portion thereof completely protrudes from the recess, thus releasing the sliding of the movable body.

Moreover, this device of the known type has a further drawback: as also observed previously, when the movable body is in the passive position the coded knobs are arranged necessarily so as to define the opening combination; in order to prevent someone from being able to read this combination in this condition it is therefore necessary, after each use, to return the movable body to the passive condition and rotate the coded knobs in order to achieve the locking of said movable body, and this may be inconvenient.

Italian application no. VE2007A000070 dated Oct. 3, 2007, is also known which claims a protective device, particularly for a lock of a door or leaf, which comprises a covering element associated slidingly with a plate which can be fixed to said door or leaf and can be arranged selectively so as to close an opening, for accessing said lock, which is formed in said plate, at least two pins being associated transversely with said plate and cooperating with cams accommodated rotatably within said plate and adapted to block temporarily the sliding of said covering element with respect to said plate, characterized in that said cams interact with a magnet-based combination element adapted to modify the angular position of said cams in order to allow or prevent the temporary mutual release of said pins and said covering element.

Even this solution has drawbacks, because the thief might still detect, by listening to the movement of the cams, their position and achieve the condition for disengaging the pins.

SUMMARY OF THE INVENTION

The aim of the present invention is therefore to solve the described technical problems, eliminating the drawbacks of the cited background art and therefore devising an invention that makes it possible to protect effectively the access to a lock, thus preventing attempts to tamper with it.

Within the scope of this aim, an important object is to provide an invention that allows preventing a thief from achieving a condition of access to the lock after listening to the protective device with which it is associated.

Another object of the invention is to make access to the lock extremely difficult even for an expert picker.

Yet another object is to provide an invention that can be applied also to common locks of the known type.

Another object is to provide an invention that is structurally simple and has relatively low manufacturing costs.

This aim and these and other objects that will become more apparent hereinafter are achieved by a protective device 1, particularly for a lock of a door or leaf, comprising a covering element 9 which is associated slidingly with a plate 2 that can be fixed to said door or leaf and can be positioned selectively so as to close an opening 3, for access to said lock, which is provided in said plate 2, one or more pins 8*a*, 8*b*, 8*c* being associated transversely with said plate and being adapted to block temporarily the sliding of said covering element, said device comprising at least one cam, rotatably mounted freely within a cavity 5 provided in said plate 2, characterized in that at least one first recess 16 and at least one second recess 18 are provided in the lateral surface of said at least one cam, which have, in plan view, a mutually different shape and are adapted respectively to allow and prevent the sliding of said covering element 9.

BRIEF DESCRIPTION OF THE DRAWINGS

Further characteristics and advantages of the invention will become more apparent from the detailed description of a particular but not exclusive embodiment, illustrated by way of non-limiting example in the accompanying drawings, wherein.

DESCRIPTION OF THE PREFERRED EMBODIMENTS

Figure 1:
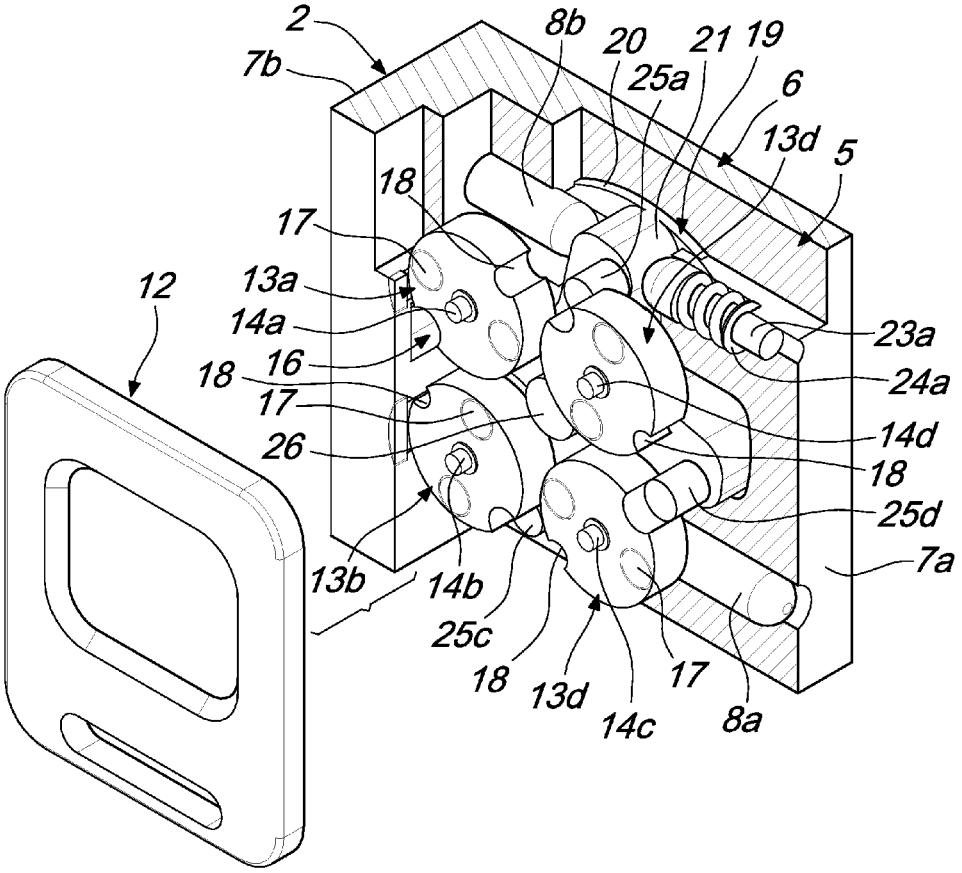
FIG. 1 is an exploded front perspective view of the device according to the invention.
Figure 2:
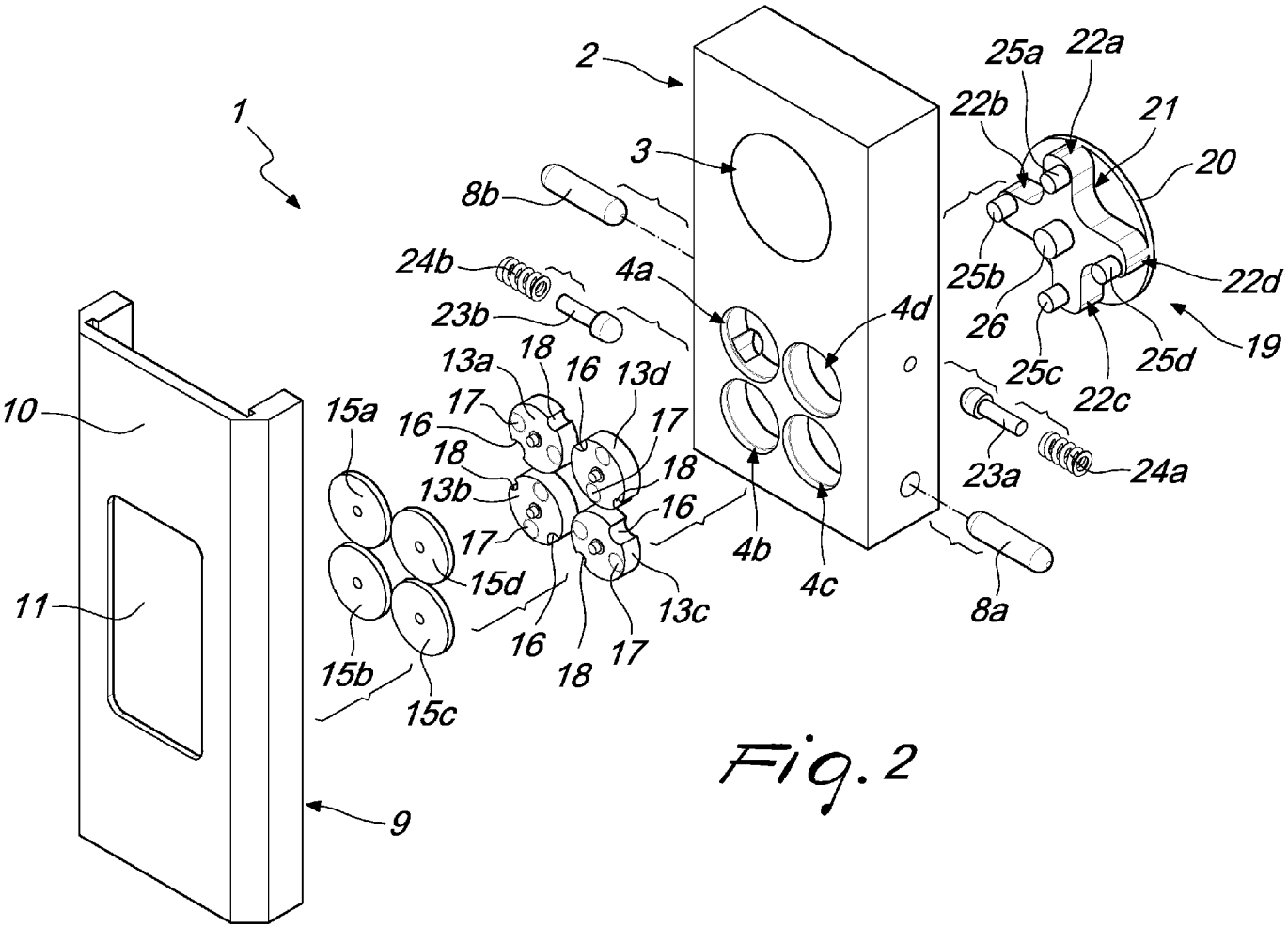
FIG. 2 is an exploded view of some components of the invention.
Figure 3:
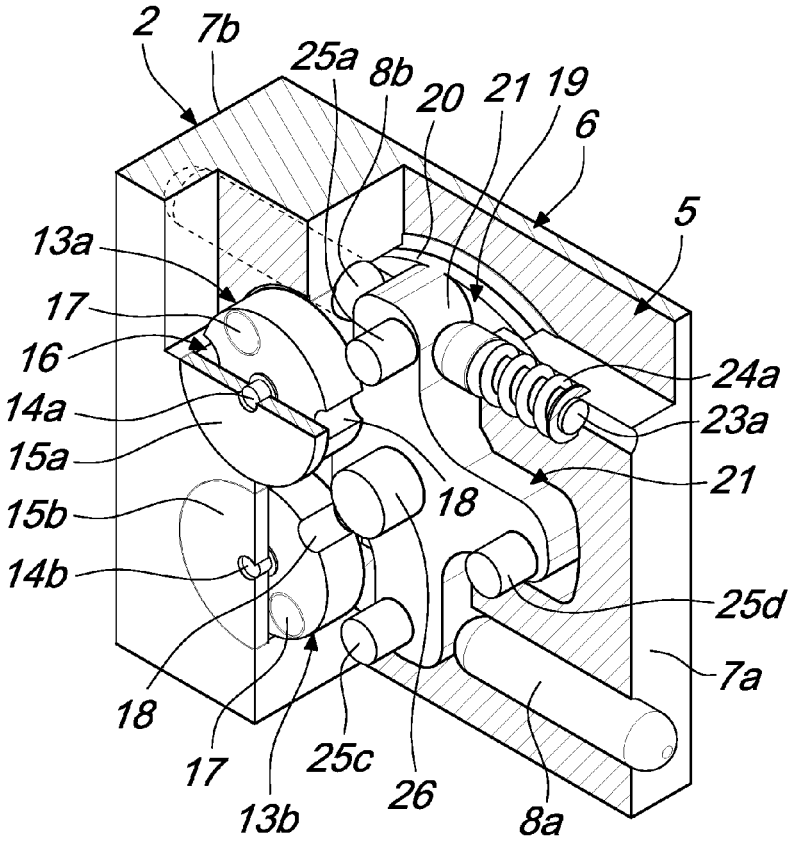
FIGS. 3 and 4 are respectively a perspective view and a front view of the plate of the device of the previous figures.

In the constructive examples that follow, individual characteristics, given in relation to specific examples, may actually be interchanged with other different characteristics that exist in other constructive examples.

Moreover, it is noted that anything found to be already known during the patenting process is understood not to be claimed and to be the subject of a disclaimer.

With reference to the accompanying figures, the reference numeral 1 designates a protective device, particularly for a lock, not shown in the accompanying figures, of a door or leaf, such as, for example, the door for access to a home, a gate, the door of a safe cabinet, the door of a safe.

The device 1 comprises a plate 2, which can be fixed to the door or leaf in such a position as to cover its lock, not shown in the accompanying figures.

In the upper region of the plate 2 there is an adapted access opening 3, which is arranged, in use, in front of the lock, so as to allow access to it and the insertion of a key therein.

In the lower region of the plate 2 there are at least three first seats, preferably three or four and designated by the numerals 4*a*, 4*b*, 4*c*, 4*d*, which have a substantially circular plan shape and are arranged with their centers at the corners of a polygon constituted, in the particular embodiment, by a square.

As an alternative, the number of seats might also be more than four and their centers might be at a polygon that has an equal number of sides; thus, if the seats are five the polygon will be a pentagon and so forth.

Within the plate 2 there is, at the rear of the four first seats 4*a*, 4*b*, 4*c*, 4*d* and connected thereto, a cavity 5 whose dimensions are at least equal to the projection of said four first seats 4*a*, 4*b*, 4*c*, 4*d* on the rear wall 6 of the plate 2.

On the side walls 7*a*, 7*b* of the plate 2 there are, at the cavity 5, two offset and mutually opposite through openings which act as seats for two pins 8*a*, 8*b*, which advantageously have an approximately hemispherical head and whose axis is arranged respectively approximately proximate to the tangent to the first seats 4*a*, 4*d* and 4*b*, 4*c*.

Figure 12:
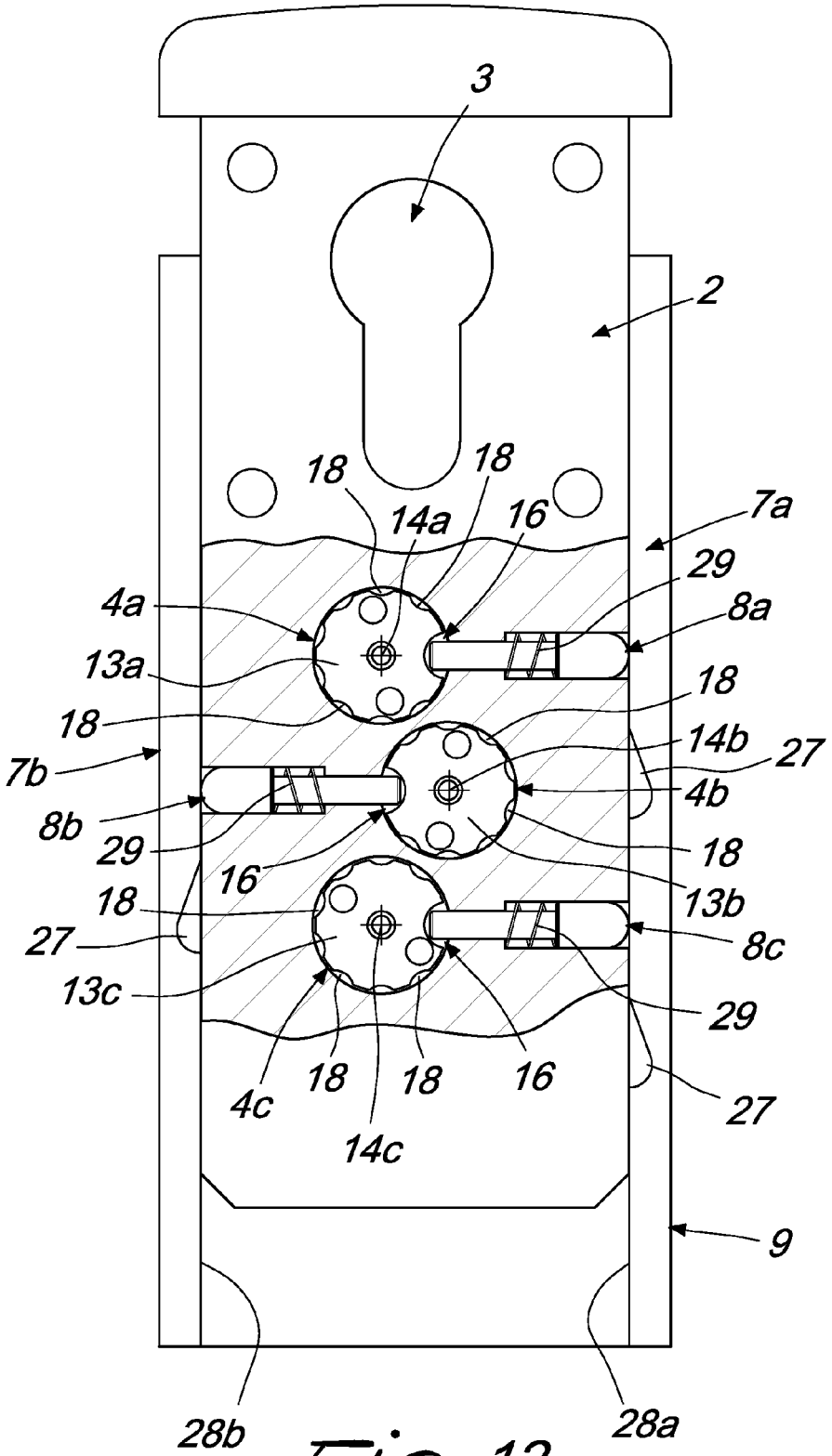
FIG. 12 is a view of a further embodiment.

In the embodiment shown in FIG. 12, the pins are three and are designated by the reference numerals 8*a*, 8*b*, 8*c*, and so are the cams, designated by the reference numerals 13*a*, 13*b*, 13*c*.

As an alternative, the cams, as well as the pins, can be two or four or more.

Said pins 8*a*, 8*b*, 8*c* are longer than the thickness of the side walls 7*a*, 7*b* and are designed to block temporarily, when they protrude with one end beyond said side walls 7*a*, 7*b*, the sliding of a covering element 9 which is associated slidingly and frontally with said plate 2 so as to block temporarily access to the access opening 3.

On the front wall 10 of the covering element 9 there is an opening 11 which acts as seat for the positioning of a magnetic key 12; said opening 11 is arranged so that in the condition in which the covering element 9 blocks the access opening 3 it lies in front of the four first seats 4*a*, 4*b*, 4*c*, 4*d*.

At least three cams, preferably four and designated by the numerals 13*a*, 13*b*, 13*c*, 13*d*, can be positioned at said seats so that they can rotate freely and are kept in position by means of adapted axes 14*a*, 14*b*, 14*c*, 14*d*, which are supported by adapted disks 15*a*, 15*b*, 15*c*, 15*d* arranged so as to close the four first seats 4*a*, 4*b*, 4*c*, 4*d* so as to avoid also the escape of said cams from said first seats.

Each one of said cams 13*a*, 13*b*, 13*c*, 13*d* is substantially cylindrical and on the lateral surface of at least one of them there is, along a generatrix, at least one first recess 16, which is preferably but not necessarily approximately semicircular in plan view; advantageously, one or more first magnets 17 are associated with each one of said cams 13*a*, 13*b*, 13*c*, 13*d*.

On the lateral surface of each one of said cams 13*a*, 13*b*, 13*c*, 13*d* there is, moreover, as shown in FIGS. 8 to 11, at least one additional second recess 18, which differs from the first recess 16 in that it has a semicircular plan shape with a smaller diameter.

A rotor 19 can be positioned rotatably within the cavity 5 and is composed of a disk-shaped back 20, from which a protrusion 21 having a star-like plan shape protrudes which has, in the particular embodiment, an X-like shape with four arms 22*a*, 22*b*, 22*c*, 22*d* which are identical and mutually equidistant.

The thickness of the back 20 and the size of the four arms 22*a*, 22*b*, 22*c*, 22*d* are such that the arms 22*a*, 22*c* interact with the pins 8*a*, 8*b*.

The thickness of the back 20, moreover, is such that it is arranged approximately adjacent to the surfaces of said facing cams 13*a*, 13*b*, 13*c*, 13*d*.

The rotation of the rotor 19 occurs in contrast with at least one elastically deformable means constituted, in the particular embodiment, by two pistons 23*a*, 23*b*, which advantageously have an approximately hemispherical head and can slide axially, in contrast with a pair of springs 24*a*, 24*b*, within adapted seats provided in the side walls 7*a*, 7*b* along a same axis respectively of said pins 8*a*, 8*b*.

At least four pivots 25*a*, 25*b*, 25*c*, 25*d* and a central pivot 26 protrude from the vertices of said arms 22*a*, 22*b*, 22*c*, 22*d*; said central pivot 26 is arranged in a central region with respect to said cams 13*a*, 13*b*, 13*c*, 13*d* and acts as a fulcrum for the rotation of the rotor 19.

Each one of the four pivots 25*a*, 25*b*, 25*c*, 25*d* has such dimensions as to be able to be arranged at one of said first recesses 16 or second recesses 18 provided in each one of said cams 13*a*, 13*b*, 13*c*, 13*d*; in the first case the rotation of said cams is prevented, and in the second case there is still a play that makes it possible to impose a rotation on the cams.

The shape, and therefore for example the diameter, and the depth of the second recesses 18 are in fact such as to allow the temporary interaction of the pivots 25*a*, 25*b*, 25*c*, 25*d* (which enter them) with them, but are also such as to allow the cams to rotate further and to maintain the condition of temporary locking of the sliding of said covering element 9.

In the embodiment illustrated in FIG. 12 the pins 8*a*, 8*b*, 8*c* are arranged and have such dimensions as to be able to be arranged selectively at one of said first recesses 16 or second recesses 18 provided in each one of said cams 13*a*, 13*b*, 13*c*; in this solution also, in the first case the sliding of the covering element 9 is allowed and in the second case said sliding is prevented.

Said pins 8*a*, 8*b*, 8*c* interact, at the end opposite to the one that interacts with the first recesses 16 or second recesses 18, with adapted seats 27 provided in the side walls 28*a*, 28*b* of the covering element 9 that can slide with respect to the plate 2, which in turn can be fixed to the door or leaf.

This interaction occurs in contrast with an adapted spring 29, the function of which it is to force said pins 8*a*, 8*b*, 8*c* toward said seats 27 so as to force their disengagement from said first or second recesses 16, 18.

The seats 27 have an orientation according to an inclined plan so as to facilitate, during the sliding of said covering element 9 with respect to said plate 2, the arrangement of said pins 8*a*, 8*b* in said first or second recesses 16, 18.

Moreover, it is noted that the first and second recesses 16, 18 can affect preferably the whole thickness of the corresponding cam in which they are provided.

Moreover, the arrangement of the second recesses 18 can, with respect to the first recesses 16, be alternated or arranged according to a desired sequence; furthermore, their number may be the most disparate according to the specific requirements, and so can their dimensions and their arrangement on each cam.

Said second recesses 18 thus define false positions for the pivots 25*a*, 25*b*, 25*c*, 25*d* in their arrangement at the cams 13*a*, 13*b*, 13*c*, 13*d*, making listening and therefore tampering by a thief very difficult to achieve, because of the combination of false positions that can be reached by varying the number of the second recesses 18.

Figure 4:
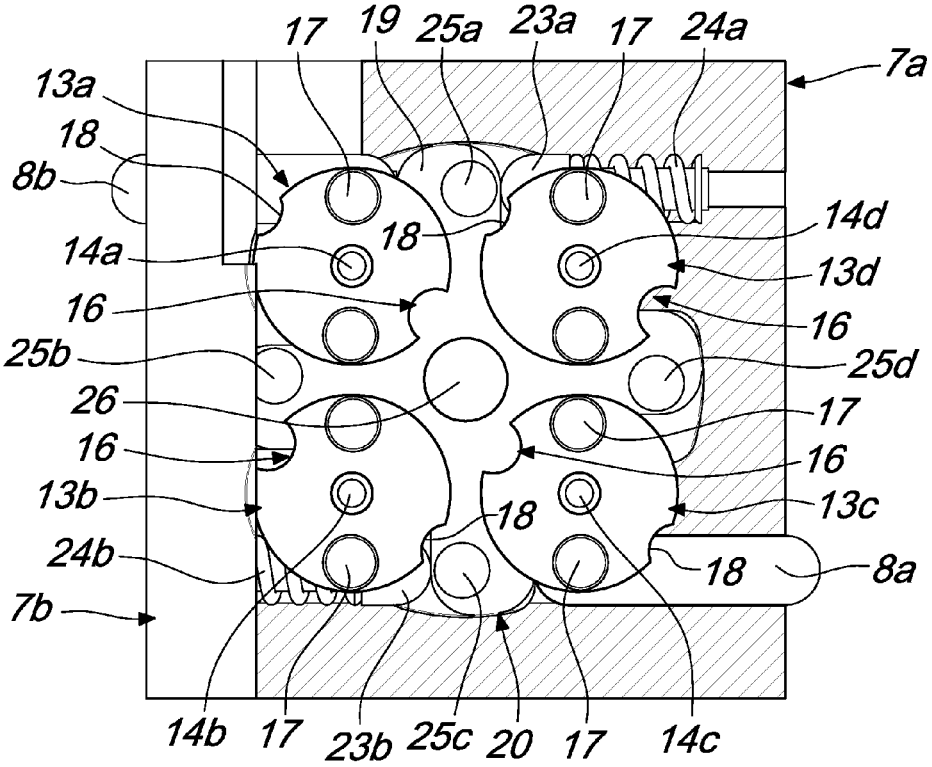
Figure 5:
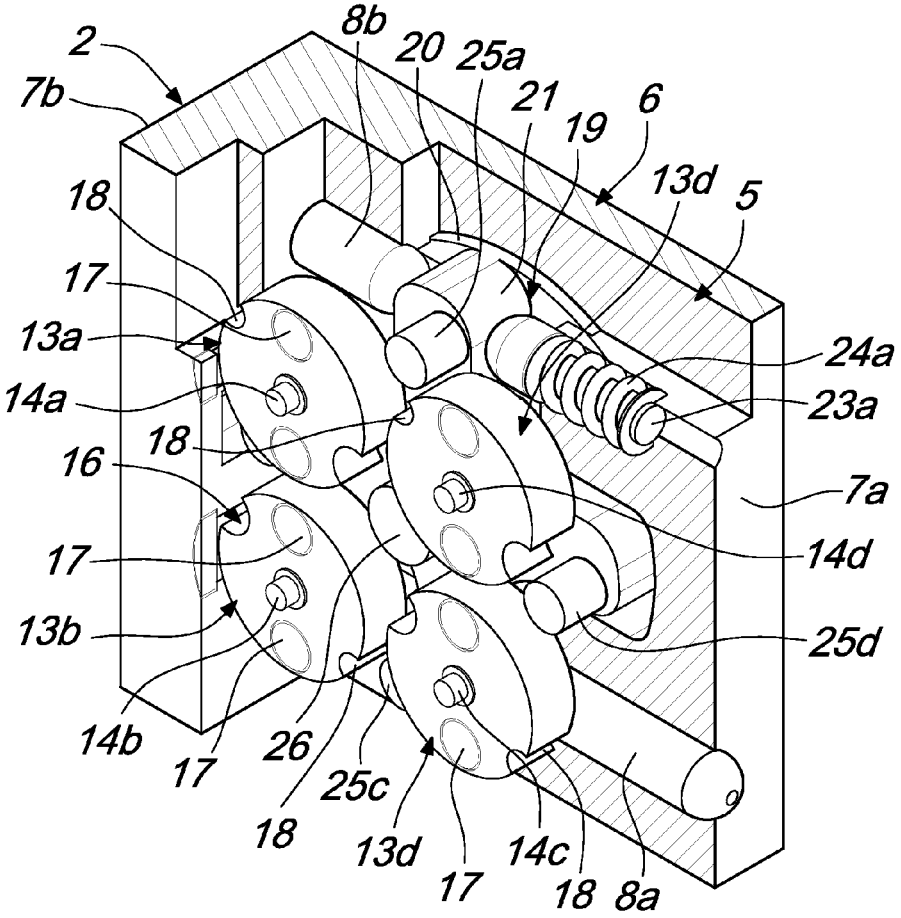
FIG. 5 is a second perspective view of the arrangement of the cams in the condition for blocking the rotation of the rotor.
Figure 6:
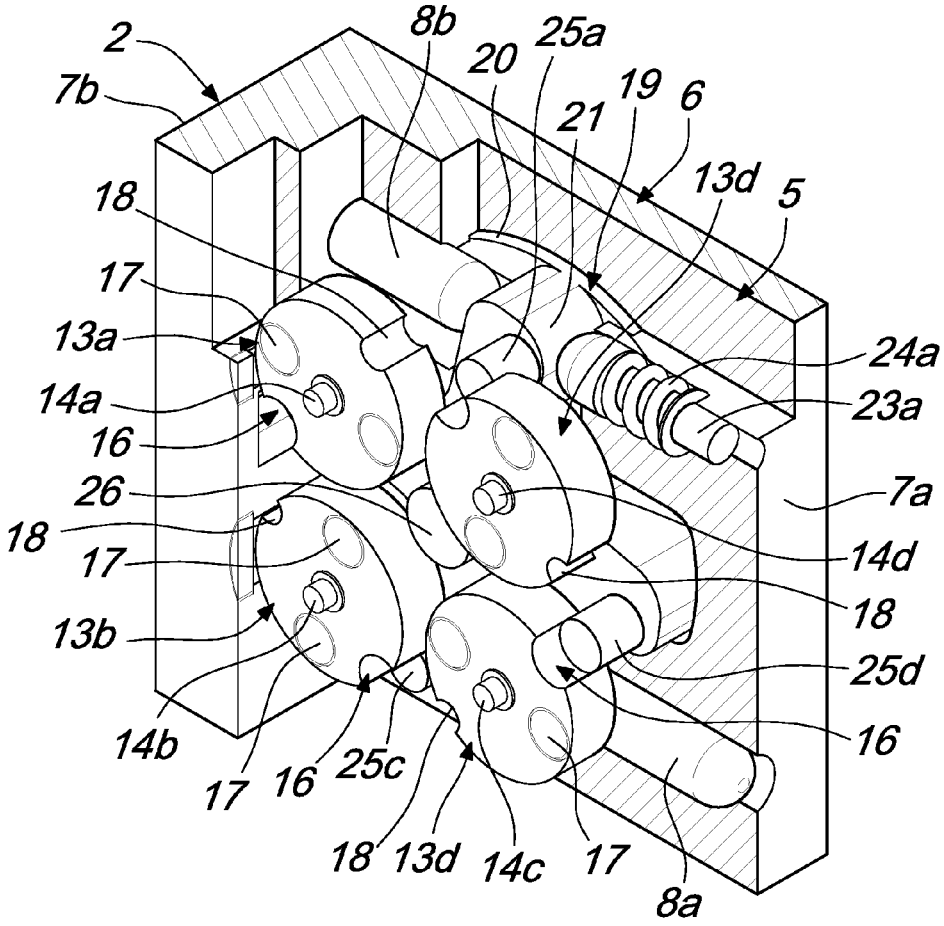
FIGS. 6 and 7 are views, similar to the ones of FIGS. 3 and 4, of the invention in the condition in which the cams allow the rotation of the rotor associated with a number of cams equal to five and six.
Figure 7:
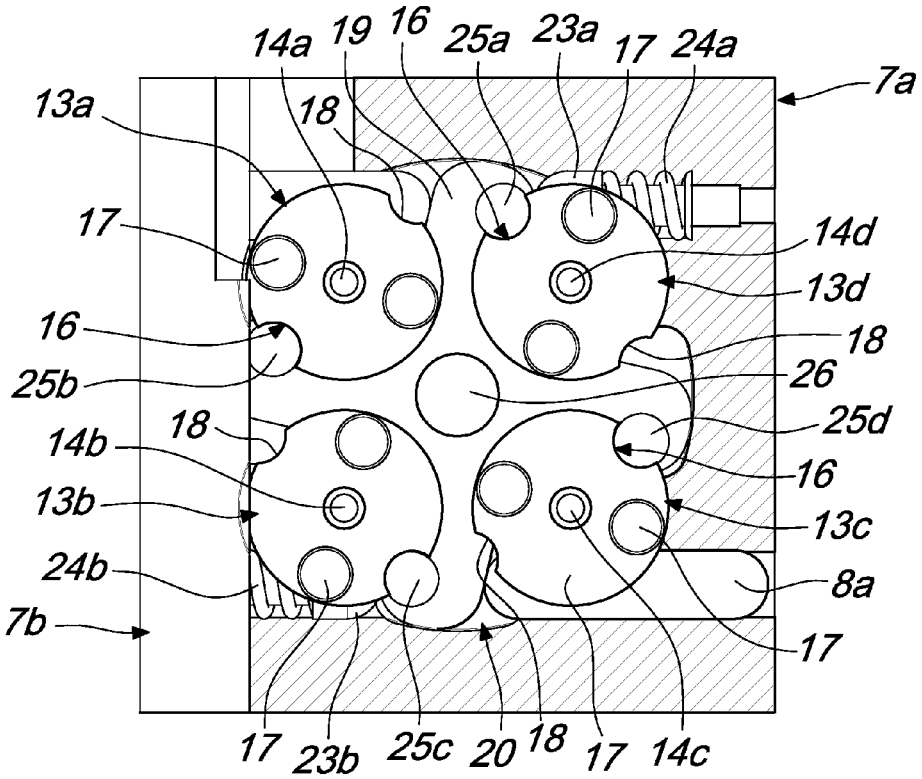
Figure 8:
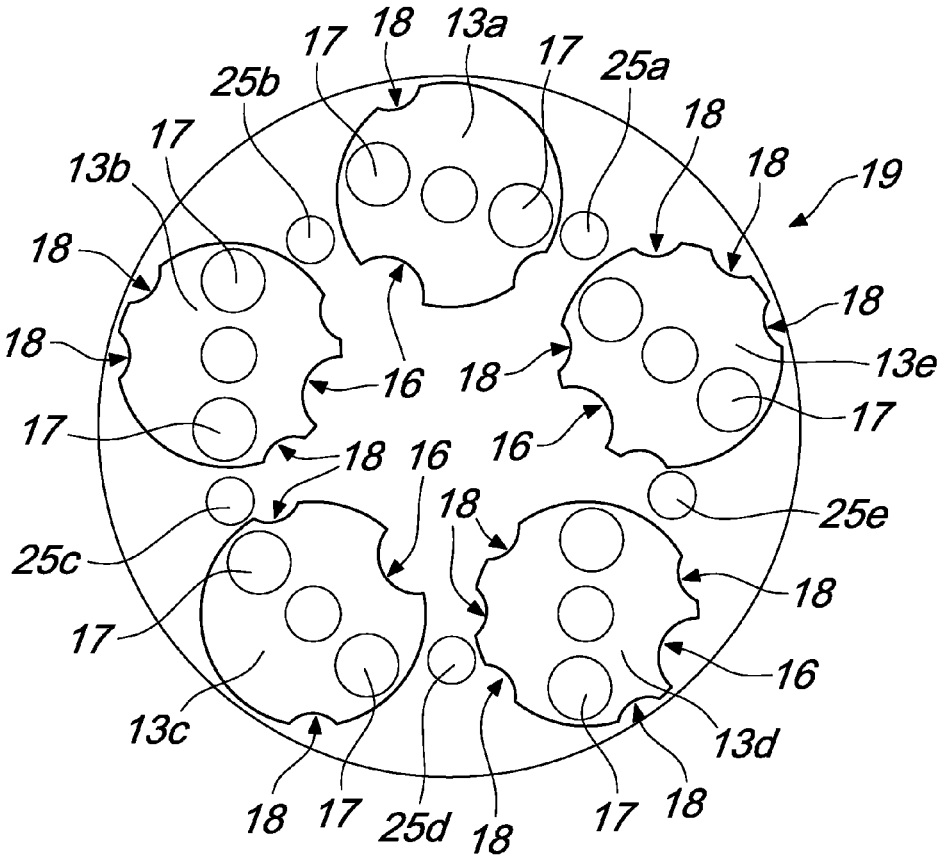
FIGS. 8 to 11 are schematic views of a different geometric shape of the rotor.
Figure 9:
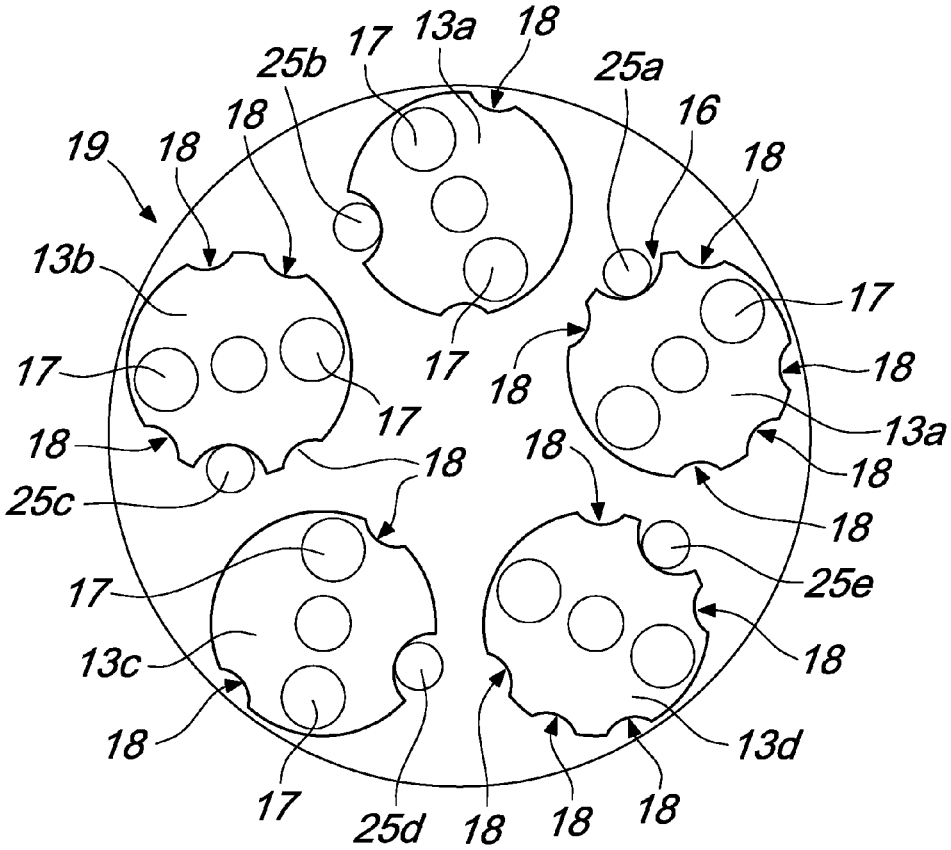
Figure 10:
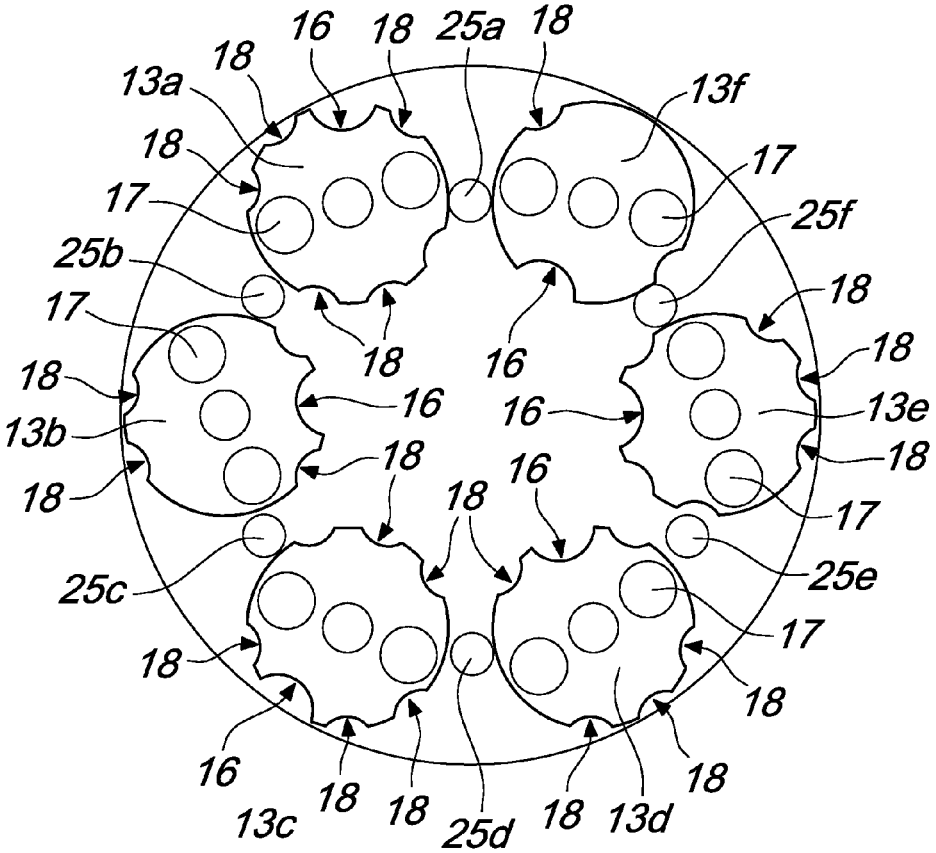
Figure 11:
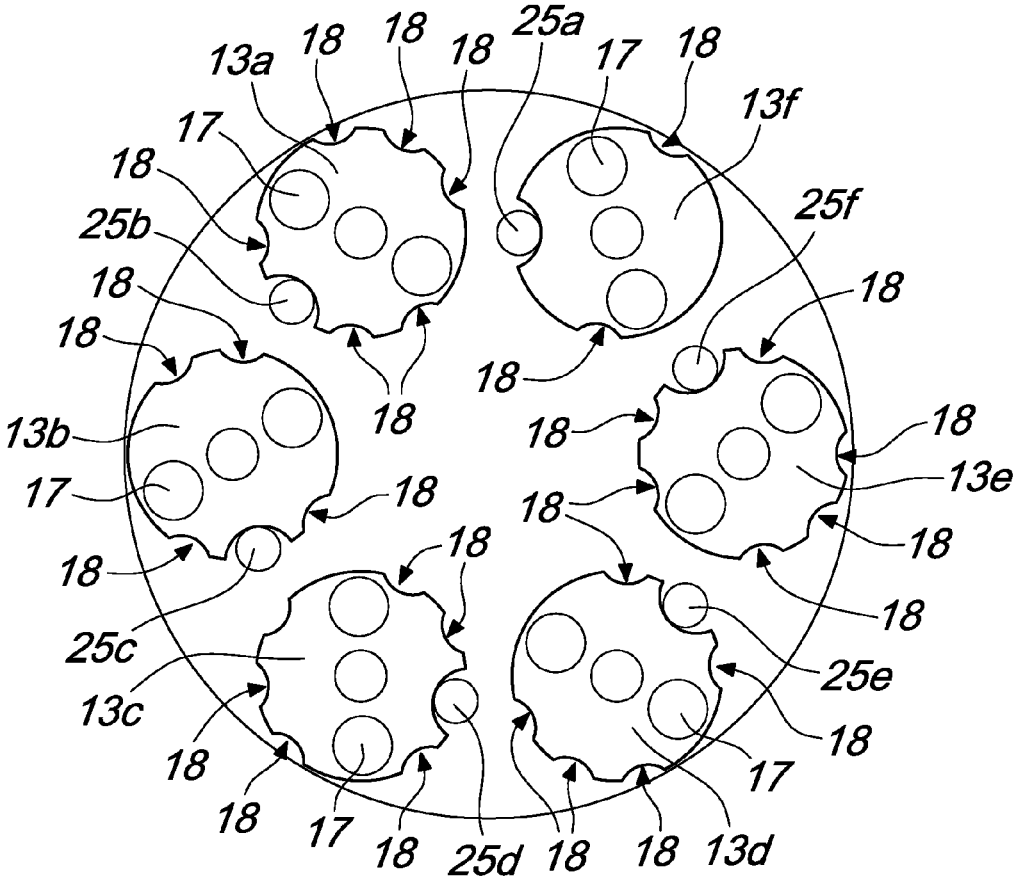

The pair of springs 24*a*, 24*b* has such an elastic constant as to slightly force the rotor 19 to maintain the stalled position, shown in FIG. 4, in which none of the four pivots 25*a*, 25*b*, 25*c*, 25*d* affects any of the first recesses 16.

Geometrically, a slight rotation imparted clockwise to the rotor 19 [forced in this direction during the sliding of the covering element 9 that forces the pins 8*a*, 8*b* to retract into the plate 2] forces the first pivots 25*a*, 25*c* to arrange themselves adjacent to the lateral surface of the cams 13*a*, 13*b*, 13*c*, 13*d*: when a rotation is imposed on said cams (as described hereinafter) that arranges the first recesses 16 in front of the first pivots 25*a*, 25*c*, they arrange themselves within the first recesses 16, allowing a further rotation to the rotor 19, thanks to the additional movement imparted to the pins 8*a*, 8*b* by an extent that is sufficient to make them retract within the side walls 7*a*, 7*b* of the plate 2, so that the covering element 9 also can slide with respect to the plate 2, freeing the access to the access opening 3 and therefore the access to the lock.

This sliding is prevented if the pivots 25*a*, 25*c* operate on the second recesses 18.

In the embodiment shown in FIG. 12, there is a direct interaction of the pins 8*a*, 8*b*, 8*c* with the first recess 16 or with one of said second recesses 18; in the first case, the covering element 9 is allowed to slide and therefore access to the lock is provided, whereas in the second case said sliding is prevented and therefore access to the lock is prevented.

The sliding of the covering element 9 is allowed by the use of the magnetic key 12, which is arranged at the opening 11: the key imposes on the cams 13*a*, 13*b*, 13*c*, 13*d* such a rotation as to place the first recesses 16 of the cams 13*a*, 13*b*, 13*c*, 13*d* in such a position as to face the first pivots 25*a*, 25*b*, 25*c*, 25*d*, thus freeing the movement of the pins 8*a*, 8*b* and the sliding of the covering element 9; in the embodiment shown in FIG. 12, the simultaneous arrangement of the pins 8*a*, 8*b*, 8*c* at the first recess 16 makes it possible to disengage them from the covering element 9, which is thus free to slide.

The device 1 also comprises upper and lower stroke limiting means of the known type, which are adapted to limit the sliding of the covering element 9 longitudinally to the plate 2, so as to prevent the complete exit of said plate 2 from said covering element 9.

Upon the removal of the key 12 and the repositioning of the covering element 9 on the plate 2 to cover the access opening 3, the cams 13*a*, 13*b*, 13*c*, 13*d* are arranged randomly inside the four first seats 4*a*, 4*b*, 4*c*, 4*d*; the pistons 23*a*, 23*b* thus force the pins 8*a*, 8*b* outside the side walls 7*a*, 7*b*, which thus block the covering element 9.

It has thus been found that the invention has achieved the intended aim and objects, a protective device, particularly for a lock, having been devised which is capable of protecting effectively said lock against attempts to tamper with the lock.

This solution allows preventing a thief from achieving a condition of access to the lock after listening to the protective device with which it is associated, thanks to the presence of the second recesses 18 that define false positions for the pivots 25*a*, 25*b*, 25*c*, 25*d* in their arrangement at the cams 13*a*, 13*b*, 13*c*, 13*d*; therefore, if an ill-intentioned person tries to listen to the sound of the positioning of the pivots 25*a*, 25*b*, 25*c*, 25*d* in the cams 13*a*, 13*b*, 13*c*, 13*d* he will hear the sound of the arrangement of the pivots, but he will not be able to know whether they have been arranged in the first recesses 16, the only condition that makes it possible to achieve opening.

Moreover, the device according to the invention can be applied easily also to common locks of the known type.

Moreover, the production costs of the device according to the invention are kept low, since it is provided only by means of components that are easy to produce and/or assemble.

Of course, the invention is susceptible of numerous modifications and variations, all of which are within the scope of the appended claims.

Thus, for example, the key 12 will be such as to arrange, once it has been moved closer to the opening 11, the cams 13*a*, 13*b*, 13*c*, 13*d*, 13*e*, 13*f* in the position facing the first recesses 16.

The number of second recesses 18 also can increase so as to increase the false positions of the pivots 25*a*, 25*b*, 25*c*, 25*d*, 25*e*, 25*f* which, arranged therein for example by a thief who might operate on the cams 13*a*, 13*b*, 13*c*, 13*d*, 13*e*, 13*f* with an external magnet, will not allow the sliding of the covering element 9 and therefore will not reveal the lock.

The shape of the second recesses 18 also may vary depending on the means that interfere with them.

The protective device according to the invention can be used in order to protect and allow a selective access for example to a switch, to an actuator and, in general, to any element that can be accessed selectively.

Moreover, the number of the first seats may be larger than four, and likewise there can be an increase in the number of the cams, which may be also five or six or more, as illustrated in FIGS. 8 to 12 and designated by the reference numerals 13*a*, 13*b*, 13*c*, 13*d*, 13*e*, 13*f*.

As a consequence the rotor 19 also has a protrusion with a star-like plan shape with a number of arms that is larger than four and might be even five or six, as illustrated in FIGS. 8 to 12.

Moreover, the number of the pivots accordingly might be even five or six or more, as illustrated in FIGS. 8 to 12, and designated by the reference numerals 25*a*, 25*b*, 25*c*, 25*d*, 25*e*, 25*f*.

Said pins shall lie on the vertices of a pentagon or a hexagon or other polygons with more sides.

Thus, the positions of the pins 8*a*, 8*b* and of the pistons 23*a*, 23*b* also may be swapped, meaning that the pin 8*b* will take the place of the piston 23*a*, consequently redefining the respective seats at the side walls 7*a*, 7*b* of the plate 2; likewise, the pin 8*a* will take the place of the piston 23*b*, consequently redefining the respective seats at the side walls 7*a*, 7*b* of the plate 2. The positioning of the cams 13*a*, 13*b*, 13*c*, 13*d*, 13*e*, 13*f* also may be the most suitable according to specific requirements.

Likewise, the shape of the rotor may be the most suitable according to, for example, the number and position of said cams 13*a*, 13*b*, 13*c*, 13*d*, 13*e*, 13*f*.

The term "substantially" has the meaning that the shape or configuration to which it refers, is as indicated, but for shape tolerances that are known to those skilled in the art.

Said cams may be present in a different number than the one shown in the accompanying drawings.

The materials used, as well as the dimensions that constitute the individual components of the invention, may of course be more pertinent to the specific requirements.

The various means for performing certain different functions need not certainly coexist only in the illustrated embodiment but can be present per se in many embodiments, even if they are not illustrated.

The characteristics indicated as advantageous, convenient or the like may also be omitted or be replaced with equivalents.

The disclosures in Italian Patent Application No. TV2011A000069 from which this application claims priority are incorporated herein by reference.

What is claimed is:

1. A protective device for a lock of a door or leaf, comprising:

a covering element which is associated slidingly with a plate which can be fixed to said door or leaf and can be positioned selectively so as to close an opening for access to said lock which is provided in said plate;

one or more pins associated transversely with said plate and adapted to block temporarily sliding of said covering element;

at least one cam, rotatably mounted freely within a cavity provided in said plate;

at least one first recess and at least one second recess provided on a lateral surface of said at least one cam;

said recesses having, in plan view, a mutually different shape and being adapted, respectively, to allow and prevent sliding of said covering element; and blocking means adapted to block or allow sliding of said covering element slidingly associated with said plate, said blocking means interacting selectively with said at least one first recess and said at least one second recess.

2. The device of claim 1, wherein said at least one cam has a substantially cylindrical shape and is provided, on the lateral surface, along a generatrix, with said at least one first recess and at least one second recess, said recesses being substantially semicircular in plan view.

3. The device of claim 2, wherein said at least one cam is associated with one or more first magnets and has, on the lateral surface, said at least one second recess which differs from said at least one first recess in that said at least one second recess has, in plan view, a semicircular shape with a diameter that is smaller than that of said at least one first recess.

4. The device of claim 3, wherein a shape, a diameter and depth, of said at least one second recess is provided such as to allow temporary interaction thereof with pivots provided on a rotor positioned in said cavity or, directly, with said pins, but is also such as to allow a further rotation to said at least one cam and to maintain a condition of temporary blocking of a sliding of said covering element.

5. The device of claim 4, wherein said at least one first recess and said at least one second recess, preferably, extend over the entire thickness of said at least one cam on which they are provided.

6. The device of claim 5, wherein a location of said at least one second recess is alternated with respect to a location of said at least one first recess.

7. The device of claim 5, wherein a location of said at least one second recess is, with respect to a location of said at least one first recess, arranged according to a selected sequence, said at least one first and second recesses being mutually equal or different in number.

8. The device of claim 7, wherein said at least one second recess forms at least one false position for said blocking means adapted to block or allow sliding of said covering element in their positioning at said cams.

9. The device of claim 1, wherein a shape, a diameter and depth, of said at least one first recess is such as to allow temporary blocking interaction with said pivots provided on a rotor positioned in said cavity or directly with said pins so as to prevent the momentary rotation of said at least one cam and allow the sliding of said covering element.

10. A protective device for a lock of a door or leaf, comprising:

a covering element which is associated slidingly with a plate which can be fixed to said door or leaf and can be positioned selectively so as to close an opening for access to said lock which is provided in said plate;

one or more pins associated transversely with said plate and adapted to block temporarily sliding of said covering element;

at least one cam, rotatably mounted freely within a cavity provided in said plate;

at least one first recess and at least one second recess provided on a lateral surface of said at least one cam; and said recesses having, in plan view, a mutually different shape and being adapted, respectively, to allow and prevent sliding of said covering element, wherein said at least one cam has a substantially cylindrical shape and is provided, on the lateral surface, along a generatrix, with said at least one first recess and at least one second recess, said recesses being substantially semicircular in plan view, said at least one cam being associated with one or more first magnets and having, on the lateral surface, said at least one second recess which differs from said at least one first recess in that said at least one second recess has, in plan view, a semicircular shape with a diameter that is smaller than that of said at least one first recess, and blocking means adapted to block or allow sliding of said covering element slidingly associated with said plate, said blocking means interacting selectively with said at least one first recess and said at least one second recess.

* * * * *